United States Patent [19]

Chapman

[11] 3,949,561

[45] Apr. 13, 1976

[54] SOIL GROUTING APPARATUS

[76] Inventor: Roger S. Chapman, 93 Mohawk Drive, Wallingford, Conn. 06492

[22] Filed: June 27, 1974

[21] Appl. No.: 483,655

[52] U.S. Cl. ..... 61/36 R; 61/53.64; 61/63

[51] Int. Cl.[2] ..... E02D 3/12

[58] Field of Search ..... 61/35, 36 R, 41, 53.52, 61/53.64, 63, 39; 166/202; 175/323

[56] References Cited

UNITED STATES PATENTS

| | | | |
|---|---|---|---|
| 1,369,891 | 3/1921 | Halliburton | 61/36 R UX |
| 2,860,489 | 11/1958 | Townsend | 61/63 |
| 3,269,126 | 8/1966 | Freeman | 61/36 R X |
| 3,359,742 | 12/1967 | Blatter | 61/39 X |
| 3,464,216 | 9/1969 | Turzillo | 61/53.64 |
| 3,518,834 | 7/1970 | Gnaedinger et al. | 61/36 R |
| 3,541,797 | 11/1970 | Stewart | 61/35 |
| 3,566,962 | 3/1971 | Pease | 166/202 X |
| 3,685,303 | 8/1972 | Turzillo | 61/63 |
| 3,754,401 | 8/1973 | Lipow | 61/39 |
| 3,760,878 | 9/1973 | Peevey | 166/202 X |

*Primary Examiner*—Paul R. Gilliam
*Assistant Examiner*—David H. Corbin
*Attorney, Agent, or Firm*—DeLio and Montgomery

[57] ABSTRACT

Apparatus for delivering grouting material, in controlled quantities and at desired pressures, to selected zones along the vertical extent of a borehole which includes the provision of vertically spaced retractable and expansible barriers or dams adapted to isolate a portion (zone) of the borehole wall from portions (zones) above and below it while grouting material is forced into the ambient earth in the region of said zone, with minimal possibility of escape to other zones. In the preferred method of utilizing the apparatus, the first zone to be grouted is the lowest, the grout controlling barriers or dams being moved upward step-by-step or continuously to higher zones while the rate and/or pressure of the grout delivery are controlled to effect distribution of the grout as desired.

12 Claims, 17 Drawing Figures

SOIL GROUTING APPARATUS

This invention relates to apparatus for delivering material to selected zones along the vertical extent of a borehole, the zones being defined by upper and lower seals between the grout pipe and the borehole wall, different zones being made accessible for the introduction of grouting material as the pipe and seals are raised from the lowest position to successively higher positions.

The conventional method of grouting includes: drilling a hole; inserting an open-ended pipe in the hole; sealing the top of the hole with earth; pumping grout through the pipe and out the lower end as the pipe is withdrawn from the hole. Using this method in any heterogeneous soil the grout tends to be distributed over a much wider area than desired in the strata of the more pervious soils and over an insufficient area in the strata of the impervious soils.

It is an object of the present invention to provide a grout pipe which is or can be closed at its bottom end, which is associated with sealing means for sealing off a selected zone of the borehole below and above a laterally opening feeding aperture in the wall of the grout pipe, and which has means for moving the grout pipe vertically to seal off and supply grout to a plurality of zones along the vertical extent of the borehole. Each zone will contain only one type of soil, except at interfaces between soils of different types. By correlating the displacement of the grout pump to the rate of withdrawal of the grout pipe, an accurately controlled quantity of grout can be supplied to each unit length (zone) of the borehole.

As a result of the operation just described, the grout is distributed more nearly uniformly throughout the borehole, with assurance of a certain minimum radius of grout at every level. In certain soils the desired even distribution may be better accomplished by withdrawing the grout pipe to the next zone only after pressure builds up to a certain amount in the first zone.

The self-sealing grout pipe is shown herein as being combined with an auger drill or with a percussion drill, to make it possible to drill and grout in a single continuous operation. This eliminates the problem of having the sides of the borehole collapse between drill and grouting (requiring installation of a casing) and thus significantly reduces the total time required for the drilling and grouting operations.

Practical embodiments of the invention are shown in the accompanying drawings wherein.

Figure 4:
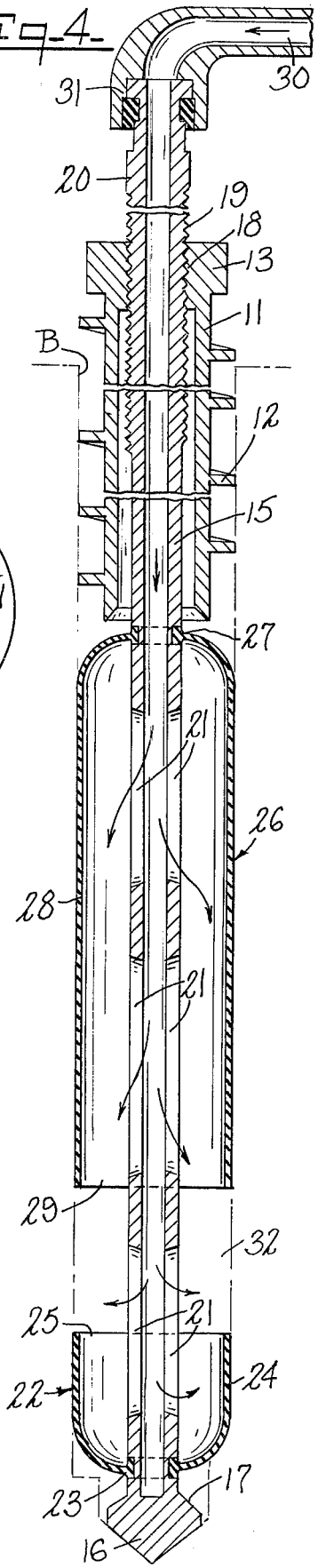
FIG. 4 represents an axial section, similar to FIG. 2, showing the parts in grouting position.
Figure 5:
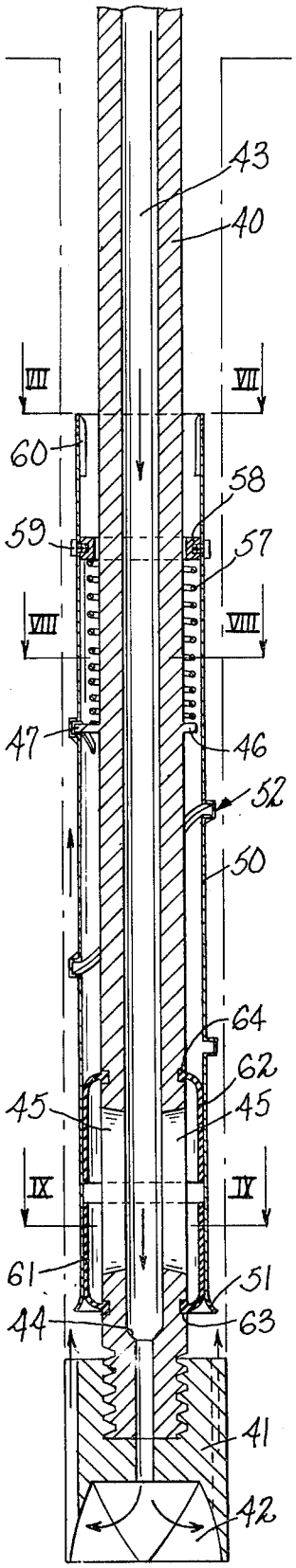
FIG. 5 represents an axial section, as in FIG. 2, of a second form of grouting means in combination with a drill.
Figure 10:
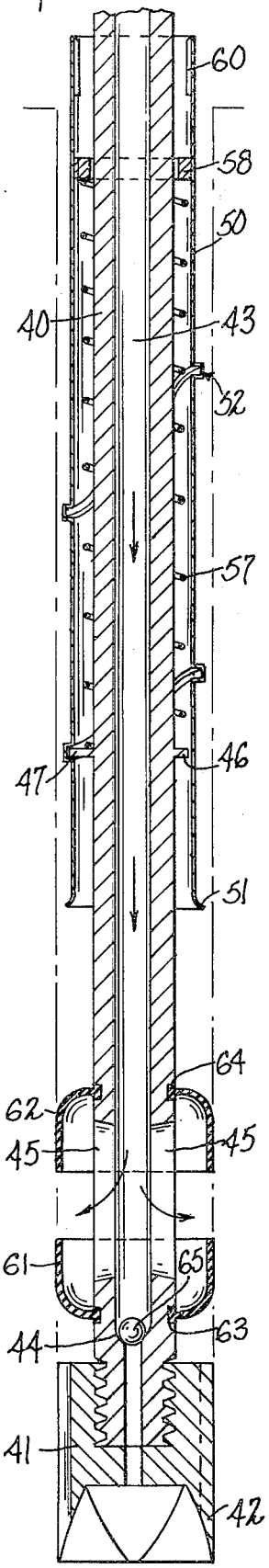
Figure 11:
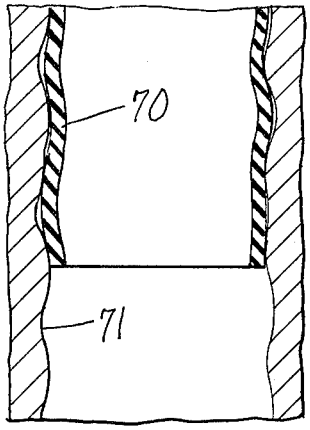
Figure 12:
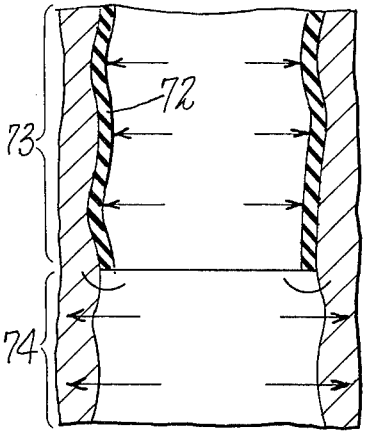
Figure 13:
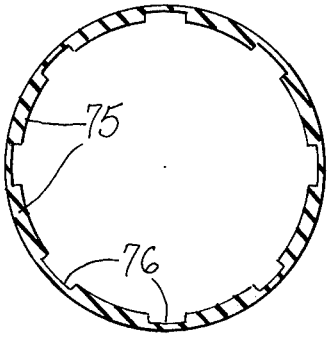
Figure 14:
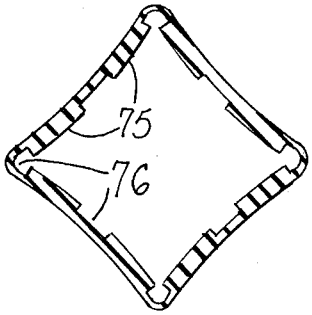
Figure 15:
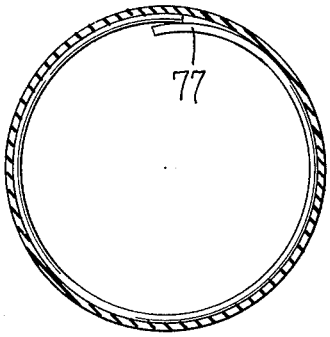
Figure 16:
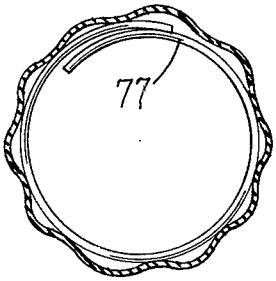
Figure 17:
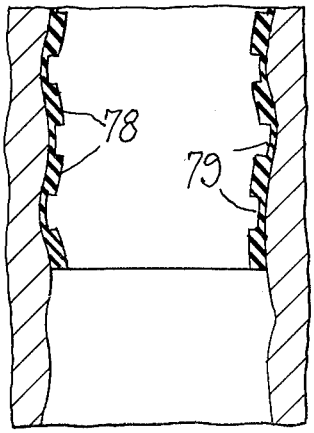

FIG. 10 represents an axial section similar to FIG. 5, showing the parts in grouting position, as in FIG. 4; and FIGS. 11 to 17 are diagrammatic illustrations of structural and operational details of the borehole sealing cuffs. FIG. 11 is a vertical section showing the approximate accommodation of the cuff to the irregular surface wall of a borehole. FIG. 12 is a vertical section with grout pressure patterns indicated by arrows. FIGS. 13 and 14 are horizontal sections showing a vertically ribbed cuff in expanded and contracted positions. FIGS. 15 and 16 are horizontal sections showing a spring-loaded cuff in expanded and contracted positions. FIG. 17 is a vertical section showing a cuff with horizontal ribs.

In the embodiment of FIGS. 1 to 4 the grouting system is shown in connection with an auger for drilling the borehole.

The auger comprises a hollow shaft 11 having the helix 12 on its outer surface and a nut 13 at its upper end. The auger is traversed by the grout pipe 15 which is closed at the bottom by a drive point 16 having an upwardly facing shoulder 17 adapted to fit against the bottom edge of the shaft 11. The auger has an inwardly facing threaded portion 18 engaged with the external threads 19 on the grout pipe and the latter has a nut 20 for controlling its rotation. The wall of the grout pipe is traversed, near its lower end, by one or more series of circumferentially spaced, vertically elongated, apertures 21 for feeding grout radially outward into the borehole.

An upwardly facing bell-shaped cuff 22 is fixed on the grout pipe at a point 23 between the lowest apertures 21 and the bottom end of the pipe, said cuff being of strong resilient material adapted for compression to lie within the auger shaft during drilling (FIG. 2) and being spring-loaded or self-expanding to assume a borehole-sealing position (FIG. 4) when the auger has been raised. The cuff 22 has a cylindrical portion 24 adjacent to its open end 25 for extended sealing contact with the wall of the borehole. A similar but much longer cuff 26 is attached to the grout pipe at a point 27, above the highest apertures 21, this cuff having a cylindrical portion 28 adjacent to its downwardly facing open end 29, the open ends 25 and 29 being spaced to define, basically, the vertical dimensions of a grouting zone.

Rotation of the auger and grout pipe together during the drilling operations, and rotation of the auger relative to the grout pipe to expose the sealing cuffs 22 and 26, are effected by drive means, not shown, which may conveniently be carried by a conventional portable drill rig with suitable adaptation.

Figure 1:
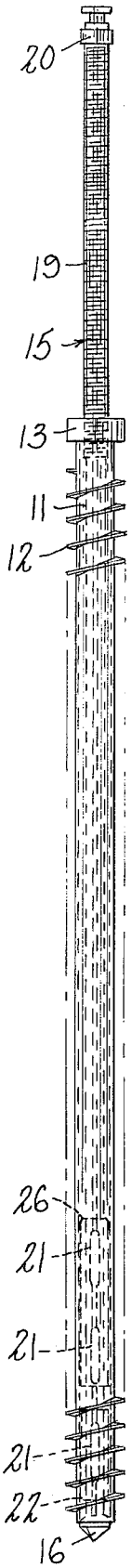
FIG. 1 represents an elevation of a first form of grouting means in combination with an earth-drilling auger.
Figure 2:
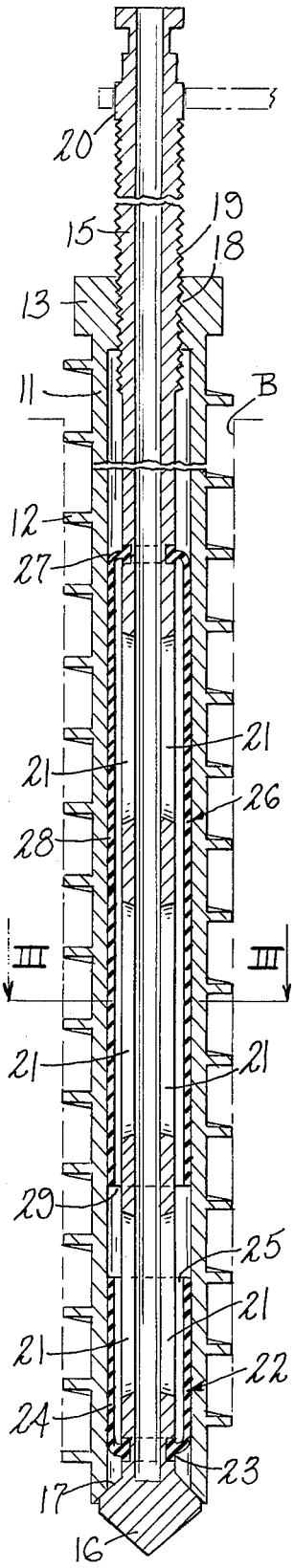
FIG. 2 represents an axial section, on a larger scale, of the apparatus shown in FIG. 1, in drilling position.
Figure 3:
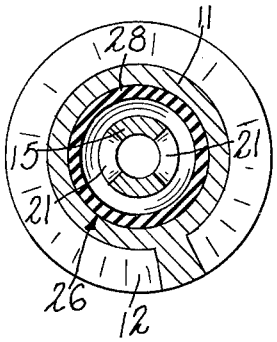
FIG. 3 represents a horizontal section, on a larger scale, taken on the line III—III of FIG. 2.

In operation, the auger is driven into the ground at a selected point by connecting a suitable drive means to the nut 13, the auger and grout pipe being engaged in the positions shown in FIGS. 1 and 2. If the soil conditions are not known from previous exploration, they can be determined by examination of the material removed as the drilling proceeds. When the desired depth has been reached the auger is turned backwards by means of the auger nut 13 while the grout pipe nut 20 is held stationary. This unscrewing of the auger, elevating it relative to the grout pipe, is continued until the bottom edge of hollow shaft 11 has cleared the upper end 27 of the upper cuff 26. The cuffs 22 and 26, when freed from the bore of shaft 11, expand so that their cylindrical portions 24 and 28 rest against the wall of the borehole B.

A grout pump, not shown, is connected to the grout pipe by means of a conduit 30 and the grout head connection 31, grout being pumped down the grout pipe 15 and out the apertures 21 for delivery to the borehole through the space 32 between the open ends 25 and 29 of the cuffs 22 and 26. As grout pressure builds up the portions 24 and 28 are forced into relatively tight sealing engagement with the borehole wall and grout is forced into the soil in the zone between the two seals. The extended length of the cylindrical sealing portion 28 prevents the grout from finding a path of low resistance upward into the borehole, while the shorter lower sealing portion 24 permits some grout to follow a short path into the bottom of the hole; when this has been filled, all the pressure acts to distribute the grout only in soil contiguous to the zone between the seals.

With the auger and grout pipe held in the grouting position (as by suitable interengagement of the nuts 13 and 20, if necessary) the assembly is withdrawn from the borehole, continuously or step-by-step, and grout is supplied to the soil adjacent to each successive higher zone of the borehole wall at rates which are functions of the rate of withdrawal and the rate and pressure of the grout supply. By linking a servo mechanism to the grout pump and the withdrawal means, each zone of the borehole can be supplied with a fixed amount of grout or can be grouted to a predetermined pressure, thus producing a more nearly uniform diameter of grout around the borehole. If the borehole traverses soils of different permeability, this condition can be compensated for by suitable regulation of the rate of withdrawal, rate of supply and/or pump pressure to achieve very accurate control of the grout distribution at all levels.

In the alternative embodiment of FIGS. 5 to 10 the grouting system is shown in connection with a vertically reciprocating drill.

The drill steel 40 has threaded on its lower end a bit 41 with teeth 42, and is traversed by an axial bore 43 which extends through the bit and is restricted above its lower end as by the annular shoulder 44, for a purpose described below. One or more axially elongated grouting holes 45 extend through the drill steel wall above the shoulder 44 so that the drill steel can serve as a grout pipe (like pipe 15 in FIGS. 1–4), and a spring collar and spacer 46 having a radially projecting boss 47 is fixed on the drill steel at a suitable distance from its lower end.

The cut-off sleeve 50 is tubular, having internal and external diameters approximately intermediate between the outside diameters of the drill steel and of the bit, being slightly flared at the bottom (as indicated at 51) and being provided with an inwardly facing cam track 52 adapted to cooperate with the boss 47 on the collar and spacer 46. The cam track has a straight portion 53 for assembly, an upper dead-end portion 54 for holding the sleeve in its lower position, a spiral portion 55 for raising the sleeve from its lower position to its higher position, and an upwardly turned lower dead-end portion 56 for holding the sleeve in its upper position. The sleeve is assembled on the drill steel (before mounting the bit) by passing the cam portion 53 over the boss 47, and installing a compression spring 57 between the upper surface of the collar and spacer 46 and the lower surface of a locking collar 58 which is fixed within the sleeve, near its upper end, by means of locking screws 59. Within the upper end of the sleeve, there are provided one or more lugs 60 for engagement by a wrench, as described below.

The drill steel carries lower and upper borehole sealing cuffs 61, 62 similar to the cuffs 22, 26, described above, and which may be of the same or different lengths, the cuff 61 having its closed end anchored in a groove 63 in the surface of the drill steel below the lower end of the grouting holes 45 while the cuff 62 has its closed end anchored in a groove 64 above the grouting holes. In its lower position the cut-off sleeve 50 covers and compresses the cuffs 61, 62 (FIG. 5) and is held in that position by the engagement of the boss 47 in the upper dead-end portion 54 of the cam groove; the spring 57 urges the sleeve upward relative to the boss, thus holding the boss in the down-turned end of the portion 54.

With the parts in the position just described the borehole is drilled to a desired depth, the drill being moved up and down, with step-by-step rotation, by conventional means (e.g. a drill rig), not shown. The broken rock and soil fragments are removed from the borehole by blowing the hole with blasts of compressed air fed to the bore 43, passing down and out through the bit 41 and up through the clearance between the borehole wall and the cut-off sleeve or drill steel. When the sleeve is in its lower position it compresses the cuffs 61, 62 with a tight sealing engagement such that air cannot escape through the grouting holes 45.

Figure 6:
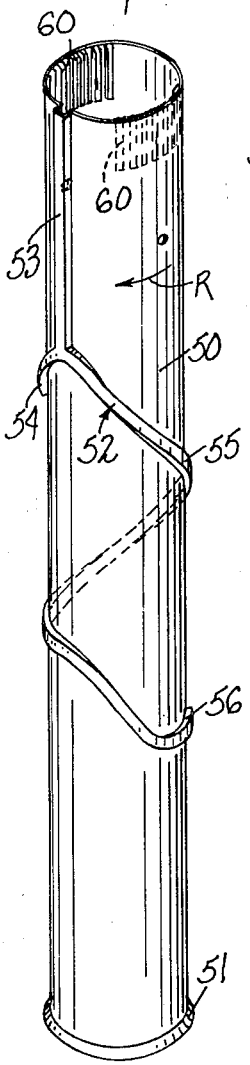
FIG. 6 represents a perspective view of the cut-off sleeve, shown in section in FIG. 5.
Figure 7:
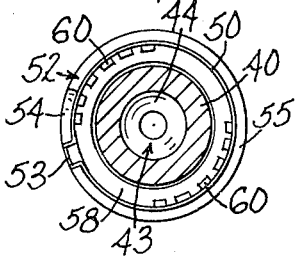
FIGS. 7, 8 and 9 represent horizontal sections, taken on the lines VII—VII, VIII—VIII, and IX—IX, respectively, of FIG. 5.
Figure 8:
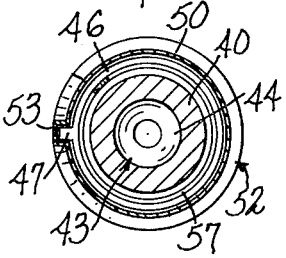
Figure 9:
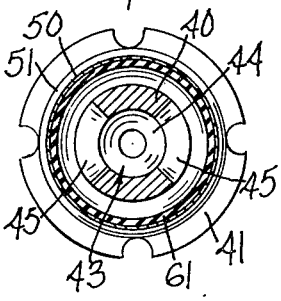

After the desired depth has been reached the cut-off sleeve is turned by means of a wrench extended down the borehole to engage the lugs 60, rotation of the sleeve in the direction of the arrow R on FIG. 6 causing the boss 47 to pass along the cam track from the dead-end portion 54, through the spiral portion 55 to the up-turned end of the lower dead-end portion 56, where the sleeve is held by gravity in its raised position and the wrench may be withdrawn. The cuffs 61, 62 being spring-loaded or self expanding, as noted above, assume positions of sealing engagement with the wall of the borehole (FIG. 10). A closure ball 65 is dropped down the bore 43 of the drill steel to rest on the shoulder 44, thus closing the bottom end of the bore.

With the drill steel bore closed, grout under pressure is pumped down the bore and out through the grouting holes 45. The grout pressure forces the sealing cuffs 61, 62 into tight engagement with the borehole wall and the grout enters the ambient soil and/or rock strata in the zone defined by the space between open edges of the sealing cuffs, the procedure and results being as described in connection with the auger type device of FIGS. 1 to 4.

All of the apparatus of either type is withdrawn from the borehole as it becomes fully grouted, so that the apparatus can be promptly flushed out, cleaned and reassembled for use at another site, the drilling and grouting having been effected as steps in a single continuous operation.

The sealing cuffs 22, 26, 61 and 62 may suitably be of neoprene or the like, appropriately compounded and with or without included reinforcement. The cylindrical portions 70 of the cuffs should be sufficiently flexible to accommodate their outer surfaces approximately to somewhat irregular (not smoothly cylindrical) borehole walls 71, as indicated in FIG. 11.

In FIG. 12 the cuff portion 72 corresponds to the cuff portion 28 of cuff 26 (FIG. 4) and to the cylindrical part of cuff 62 (FIG. 10), wherein the grout under pressure forces the cuff firmly against the borehole wall in the zone 73, adjacent to the cuff, the grout being free to enter the grouting zone 74 with only minimal intrusion into the zone protected by the sealing cuff, as indicated by the pressure and flow arrows.

Where the cuffs tend normally to assume their expanded position (FIG. 13) they may be formed with vertical internal ribs 75 for longitudinally stability and grooves 76 to facilitate collapsing radially to a position somewhat as shown in FIG. 14, where they are held, as indicated in FIGS. 2 and 5.

Expansion of the cuff may be ensured mechanically, as shown in FIGS. 15 and 16 by the provision of a simple spring 77, biased toward the expanded position of FIG. 15 but compressible to the position of FIG. 16 as required during the borehole digging or drilling phase.

In FIG. 17 the cuff is shown as being provided with circumferential ridges 78 and grooves 79 for increased flexibility, as might be required in some circumstances, to effect a tight seal against a rough borehole wall.

It will thus be seen that the objects set forth above, among those made apparent from the preceding description, are efficiently attained and, since certain changes may be made in the construction set forth without departing from the spirit and scope of the invention, it is intended that all matter contained in the above description and shown in the accompanying drawings shall be interpreted as illustrative and not in a limiting sense.

What I claim is:

1. Apparatus for grouting the soil adjacent to a borehole comprising, means for forming a borehole having a borehole wall with a first diameter, tubular means in said first named means for conveying grout from a source outside the borehole to a delivery aperture in the tubular means and within the borehole, said aperture being spaced from the lower end of said tubular means, said tubular means having a diameter substantially less than said first diameter, separate upper and lowerr expansible sealing means affixed to said tubular means at positions above and below said delivery aperture, means for confining said sealing means when the apparatus is in borehole forming mode, means for moving said confining means vertically relative to the tubular means to release the sealing means, and means for causing said sealing means to close the space between said tubular means and said borehole wall above and below said delivery aperture, whereby a zone to be grouted is defined.

2. Apparatus according to claim 1 wherein each of said sealing means is an elongated cylindrical cuff having a closed end fixed on said tubular means and an open end extending toward and spaced from the open end of the other sealing means to define a space constituting a grouting zone.

3. Apparatus according to claim 2 wherein the cuff is of a resilient material inherently expandible into sealing contact with the borehole wall.

4. Apparatus according to claim 3 wherein the cuff is internally longitudinally ridged.

5. Apparatus according to claim 2 wherein the cuff includes a compressible spring biased to expand the cuff into sealing contact with the borehole wall.

6. Apparatus according to claim 1 wherein the borehole forming means is an auger having a hollow shaft, and the tubular means is a grout pipe traversing axially said hollow shaft and movable axially thereof.

7. Apparatus according to claim 1 wherein the borehole forming means is a drill having a drill steel and carrying a bit, and the tubular means is the axially bored drill steel.

8. Apparatus according to claim 7 in which the confining means is a tubular sleeve concentric with the drill steel, having a diameter intermediate between said first diameter and the diameter of the drill steel, and which includes means associated with the drill steel and said sleeve for positioning and guiding said sleeve.

9. Apparatus according to claim 8 wherein said positioning, guiding and moving means comprise cam elements.

10. Apparatus according to claim 7 which includes means for closing the lower end of the drill steel bore.

11. Apparatus for grouting the soil adjacent to a borehole comprising, an auger for forming a borehole having a borehole wall with a first diameter, the auger having a hollow shaft, a grout pipe traversing axially said hollow shaft for conveying grout from a source outside the borehole to a lateral delivery aperture in the grout pipe and within the borehole, said aperture being spaced from the lower end of said pipe, said pipe being movable axially in said shaft and having a diameter substantially less than said first diameter and being closed at its lower end, separate upper and lower sealing means affixed to said grout pipe at positions above and below said delivery aperture, means for holding said auger and said grout pipe together in borehole forming relation with the sealing means confined within the hollow shaft, means for holding said auger and grout pipe together in grouting relation with the sealing means removed from said shaft and free in the borehole, means for effecting relative movement of said auger and grout pipe from borehole forming relation to grouting relation, and means for causing said sealing means to close the space between said grout pipe and said borehole wall above and below said delivery aperture, whereby a zone to be grouted is defined between said sealing means.

12. Apparatus according to claim 11 wherein the means for effecting relative movement includes a screw threaded engagement between the borehole forming means and the grouting means.

* * * * *